US008069611B2

(12) United States Patent
Kitayama

(10) Patent No.: US 8,069,611 B2
(45) Date of Patent: Dec. 6, 2011

(54) DOOR PANE POSITION SENSOR ASSEMBLY

(75) Inventor: Kenichi Kitayama, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 332 days.

(21) Appl. No.: 12/464,266

(22) Filed: May 12, 2009

(65) Prior Publication Data

US 2010/0287838 A1 Nov. 18, 2010

(51) Int. Cl.
*E05F 11/38* (2006.01)

(52) U.S. Cl. ..... 49/348; 49/349; 49/350; 49/351; 49/360; 49/26; 49/27; 49/28

(58) Field of Classification Search ..... 49/26, 27, 49/28, 348, 349, 350, 351, 360; 296/155
See application file for complete search history.

(56) References Cited

U.S. PATENT DOCUMENTS

| | | | | |
|---|---|---|---|---|
| 3,745,703 | A * | 7/1973 | Francis et al. | 49/103 |
| 3,844,062 | A * | 10/1974 | Daugirdas | 49/28 |
| 4,000,581 | A * | 1/1977 | Fukumoto et al. | 49/103 |
| 4,333,269 | A * | 6/1982 | Bascou | 49/280 |
| 4,554,763 | A * | 11/1985 | Dauvergne | 49/349 |
| 4,723,456 | A * | 2/1988 | Kohler et al. | 74/89.18 |
| 5,074,076 | A * | 12/1991 | Baloche | 49/351 |
| 5,461,826 | A | 10/1995 | Heckel et al. | |
| 5,921,612 | A * | 7/1999 | Mizuki et al. | 296/155 |
| 6,041,549 | A * | 3/2000 | Schust et al. | 49/375 |
| 6,114,820 | A * | 9/2000 | Nishigaya | 318/466 |
| 6,181,094 | B1 * | 1/2001 | Menke | 318/434 |
| 6,279,269 | B1 * | 8/2001 | Isomura et al. | 49/351 |
| 6,425,205 | B2 * | 7/2002 | Wygle et al. | 49/349 |
| 6,477,806 | B1 * | 11/2002 | Asada et al. | 49/169 |
| 6,502,352 | B1 * | 1/2003 | Bonduel | 49/26 |
| 6,966,148 | B2 | 11/2005 | Choi | |
| 7,055,284 | B2 * | 6/2006 | Napoli et al. | 49/349 |
| 7,100,325 | B2 * | 9/2006 | Ichinose | 49/168 |
| 7,178,854 | B2 | 2/2007 | Ichinose et al. | |
| 7,210,731 | B2 * | 5/2007 | Ichinose et al. | 296/155 |
| 2007/0138832 | A1 | 6/2007 | Kraus et al. | |

FOREIGN PATENT DOCUMENTS

JP 1058980 3/1998

* cited by examiner

*Primary Examiner* — Katherine Mitchell
*Assistant Examiner* — Marcus Menezes
(74) *Attorney, Agent, or Firm* — Rankin Hill & Clark LLP

(57) ABSTRACT

A sensor assembly and method includes a window regular mechanism having a main lift arm supporting the pane and a drive mechanism. The main lift arm includes a sector gear plate that is drivingly rotated by the drive mechanism. A slot defined in the sector gear plate receives a guide of a sensor mechanism. The guide is moved along the slot as the sector gear plate is rotated such that the guide is moved into a first portion of the slot when the sector gear plate is driven in a first rotatable direction to move the window pane toward its closed position and moved into a second portion of the slot when the sector gear plate is driven in a second, opposite rotatable direction to move the window pane toward its open position.

18 Claims, 5 Drawing Sheets

DOOR PANE POSITION SENSOR ASSEMBLY

BACKGROUND

The present disclosure relates to vehicle closures having an openable window pane, and more particularly relates to an improved sensor assembly and method for detecting or sensing the position of an openable pane in a sliding vehicle door.

Sliding doors on vehicles are increasingly equipped with a glass window pane that is openable. More particularly, the window pane of these types of sliding doors can move up and down as desired. Movement of the window pane can be controlled by a window regulator, such as an x-type window regulator.

One concern with these types of doors having openable window panes is the need to prevent or limit opening of the sliding door when the door's window pane is open. This is necessary to prevent a person or object from being caught between the door sash framing the open window and the body pillar that forms a side of the door opening in the situation where the person or object extends through the opening vacated by the window pane.

One prior art design allows a sliding vehicle door to completely open when the door pane is completely closed or when the door pane is opened less than a predetermined amount, such as an amount less than would allow a passenger head to stick out the open window. When the window is open beyond this predetermined amount, the slide door is prevented from being fully opened by a door stopper mechanism. See, for example, U.S. Pat. No. 6,477,806, expressly incorporated herein by reference.

SUMMARY

According to one aspect, an improved door pane position sensor assembly is provided. More particularly, in accordance with this aspect, the door pane position sensor assembly includes a main lift arm supporting a pane in a vehicle door. The main lift arm includes a sector gear portion for being driven to rotate the main lift arm. A drive mechanism is operatively engaged with the sector gear portion for rotating the main lift arm in a first rotatable direction to move the pane toward a closed position and a second rotatable direction to move the pane toward an open position. A cam channel is defined in the sector gear portion including a first channel portion and a second channel portion. A sensor mechanism having a follower is received in the cam channel. The follower moves along the cam channel as the main life arm rotates to move the pain toward the open and closed positions. The follower moves the sensor mechanism toward a first position when the follower is moved into the first channel portion of the cam channel and toward a second position when the follower is moved into a second channel portion of the cam channel.

According to another aspect, an improved sensor assembly is provided for detecting the position of an openable pane in a slide door of a vehicle. More particularly, in accordance with this aspect, the sensor assembly includes a window regulator mechanism including a main lift arm supporting the pane and a drive mechanism for moving the pane in downward and upward directions when the drive mechanism rotates the main lift arm in opposite directions to effect opening and closing of a window portion of the slide door. The main lift arm includes a sector gear plate at one end thereof for being drivingly rotated by the drive mechanism with the sector gear plate having a slot defined therein. A sensor mechanism has a guide received in the slot for moving along the slot as the main lift arm is rotated. The slot has a first portion that moves the guide into a first position when the guide is received in the first portion and has a second portion that moves the guide into a second position when the guide is received in the second portion.

According to still another aspect, a method of sensing window pane position in a sliding vehicle door is provided. More particularly, in accordance with this aspect, a sector gear portion of a main lift arm is drivingly rotated. An opposite end of the main lift arm is connected to a lower side of a window pane. A follower is moved along a cam channel defined in the sector gear portion as the sector gear portion is rotated. The cam channel has a first channel portion and a second channel portion. The follower is moved into the first channel portion when the sector gear portion is driven in one rotatable direction to move the window pane toward a closed position and moved into the second channel portion when the sector gear portion is driven in an opposite rotatable direction to move the window pane toward an open position.

According to a further aspect, a sliding door assembly has an assembly for sensing the position of door window glass and if the door window glass is open below a certain threshold, the sliding door is prevented from opening completely. A window regulator for opening and closing the window glass can be an X-type regulator having a main guide rail for supporting the window pane and a sub-guide rail attached to a door panel. The rails can be connected together with a main lift arm and two sub-lift arms in an X-configuration. The main lift arm is attached to or formed integrally with a sector gear that is connected to a motor for applying a motive force to the gear for raising and lowering the window glass.

DETAILED DESCRIPTION

Figure 1:
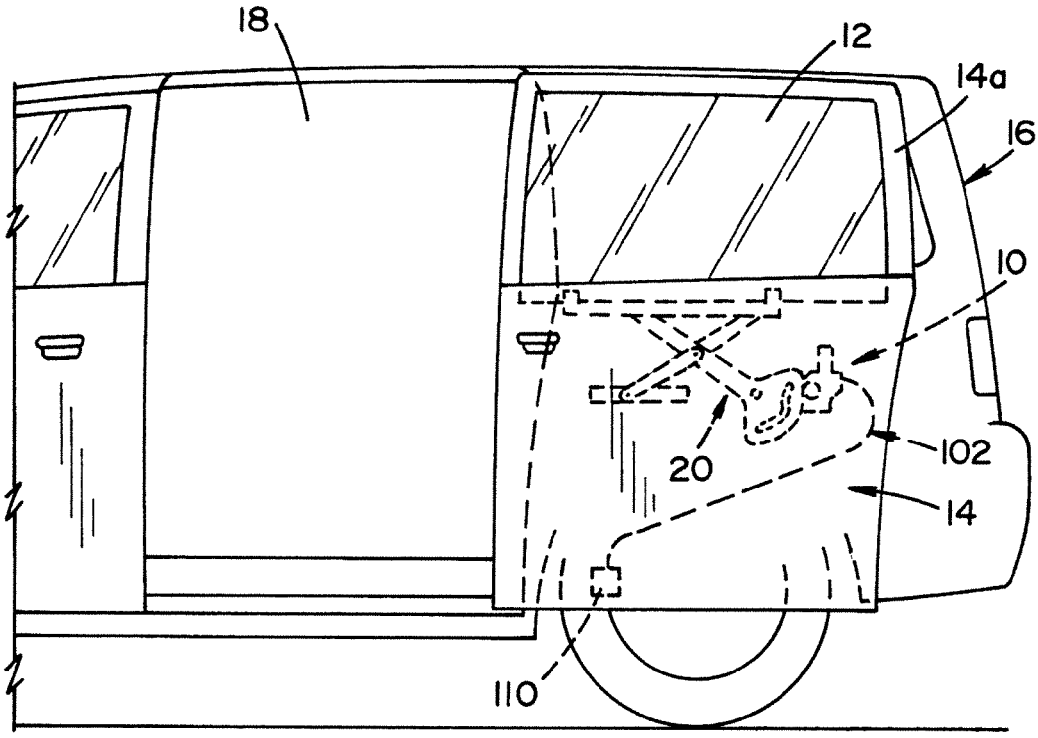
FIG. 1 is a schematic elevational view of a vehicle slide door having an openable window pane held in a closed position by a window regulator mechanism mounted to the vehicle slide door.

Referring now to the drawings, wherein the showings are for purposes of illustrating one or more exemplary embodiments, a door pane position sensor assembly 10 is illustrated for detecting the position of an openable window pane 12 in a slide door 14 of a vehicle 16, otherwise known as a sliding vehicle door. The illustrated vehicle 16 is a van-type vehicle (e.g., a mini-van), though only the rear portion thereof is shown. A door opening 18 is formed in at least one lateral side of the vehicle 16 to permit passengers or occupants to enter and/or exit a rear portion of the vehicle. The slide door 14 selectively closes the opening 18 as is known and understood by those skilled in the art. If desired, the slide door 14 can be a powered door that is optionally opened and/or closed by a motor.

The openable window pane 12 is movable in upward and downward directions by a window regulator mechanism 20 that is mounted within the vehicle door 14. The window regulator mechanism 20 includes a main lift arm 26 that supports the pane 12 in the vehicle door 14. The window regulator mechanism 20 further includes a drive mechanism 28 for moving the pane 12 in downward and upward directions when the driving mechanism 28 rotates the main lift arm 26 in opposite directions to effect opening and closing of window portion 14*a* of the door 14. The main lift arm 26 can include a sector gear portion or plate 30 at one end thereof that can be driven by the drive mechanism 28 to rotate the main lift arm 26 about pivot 32. The pivot 32, about which the main lift arm 26 is rotatable, is fixably secured to the slide door 14 and thus connects the main lift arm 26 to the vehicle door 14.

The drive mechanism 28 is operatively engaged with the sector gear portion 30 for rotating the main lift arm 26 in a first rotatable direction about pivot 32 (i.e., counter-clockwise in FIGS. 3-5) to move the pane 12 toward its closed or fully up position and a second rotatable direction about pivot 32 (i.e., clockwise in FIGS. 3-5) to move the pane toward an open position. In the illustrated embodiment, the sector gear portion 30 is a single plate having sector gear teeth 34 meshingly engaged with driving teeth 36 of the drive mechanism 28. The driving teeth 36 of the drive mechanism 28 are disposed on a pinion gear 38, which is driven by a motor 40 of the drive mechanism 28. Between the pinion gear 38 and motor 40, the drive mechanism 28 can include appropriate reduction gears in gear reduction housing 42 as is known and understood by those skilled in the art.

The window regulator mechanism 20 of the illustrated embodiment is an x-link window regulator, which includes first and second sub arms 50, 52 pivotally connected to the main lift arm 26 at floating pivot 54 (i.e., pivot 54 is not fixedly connected to the vehicle door 14, but instead floats relative to the door as the window regulator mechanism opens and closes the window pane 12). In particular, the first sub arm 50 and the main lift arm 26 have respective ends pivotally connected to a lower end 56 of the openable pane 12. That is, a first end 58 of the sub arm 50 is pivotally connected to the lower end 56 of the window pane and likewise the end 60 of the main lift arm 26 opposite the sector gear portion 30 is pivotally connected to the lower end 56 of the window pane 12.

Specifically, the ends 58, 60 of the arms 50, 26 are slidably disposed within a track member 62 (also referred to herein as a main guide rail), which is itself securely connected to the lower end 56 of the window pane 12 by brackets 64 and suitable fasteners 66, though other connection arrangements could easily be employed. The ends 58, 60 of the arms 50, 26 include pins 68 received in the track member 62 for sliding movement therealong as the window 12 pane is opened and closed. The second, opposite end 70 of the first sub arm 50 is pivotally connected to the main lift arm 26 at the floating pivot 54. The second sub arm 52 has one end (first end) 72 pivotally connected at a vertically fixed location to the door 14. More specifically, the end 72 includes a pin 74 slidably received within a track member 76 (also referred to herein as a sub guide rail), which is itself fixedly attached to the vehicle door 14. A second, opposite end 78 of the sub arm 52 is pivotally connected to the main lift arm 26 at the floating pivot 54. The pivot 32 pivotally connects the main lift arm 26 to the vehicle door 14 at a fixed location, which is disposed between a location (i.e., pivot 54) where the sub arms 50, 52 pivotally connect to the main lift arm 26 and the sector gear portion or plate 30.

The pivot 32, which provides a fixed pivot location at which the main lift arm 26 is pivotally connected to the vehicle door 14, is disposed between the ends 30, 60 of the main lift arm 26 such that the sector gear portion 30 is entirely disposed on one side of the fixed pivot location (i.e., pivot 32) along the main lift arm 26. As shown, the second end 60 of the main lift arm 26 is pivotally connected to the track member 62 that carries the lower end 56 of the window pane 12. The first sub lift arm 50 has one end (end 70) pivotally connected to the main lift arm 26 at a sub arm pivot location (i.e., floating pivot 54) between the fixed pivot location, (i.e., pivot 32) and the second end 60. The other end 58 of the arm 50 is pivotally connected to the track member 62 at a location spaced apart from where the main lift arm 26 pivotally connects to the main guide rail 60. The second sub lift arm 52 has one end 78 pivotally connected to the main lift arm 26 at the sub arm pivot location (i.e., floating pivot 54) and it has its second end 72 pivotally connected to the vehicle door 14 at a vertically fixed location via the track member 76.

As illustrated, a cam channel or slot 86 can be defined in the sector gear portion or plate 30. In particular, the cam channel or slot 86 is defined by sidewalls 88 extending through the sector gear portion or plate 30 from a first surface 30*a* of the sector gear portion or plate 30 to a second, opposite surface 30*b* of the sector gear portion or plate 30. The cam channel or slot includes a first channel portion 90 and a second channel portion 92. A sensor mechanism 94 has a follower or guide 96 received in the cam channel or slot 86 for moving along the channel or slot as the main lift arm 26 is rotated (i.e., the follower or guide 96 moves along the cam channel or slot 86 as the main lift arm 26 rotates to move the window pane 12 toward its open and closed positions). As will be described in more detail below, the follower or guide 96 moves the sensor mechanism 94 toward a first position when the follower or guide 96 is moved into the first channel portion 90 and moves the sensor mechanism 94 toward a second position when the follower or guide 96 is moved into the second channel portion 92 of the cam channel or slot 86.

The first channel portion 90 corresponds to the window pane 12 being in or between an intermediate position and its closed position and the second channel portion 92 corresponds to the window pane 12 being in or between an intermediate position and its open position. Accordingly, the sensor mechanism 94 is in the first position when the pane 12 is between an intermediate position and the closed position and in the second position when the pane 12 is between an intermediate position and the open position.

The guide or follower 96 can be a guide roller received through the single plate forming the sector gear portion 30. The guide roller 96 is guided within the channel or slot 86 by opposing sidewalls 88 of the cam channel or slot 86 which function to maintain the guide roller 96 in contact with the sector gear portion or plate 30. In the illustrated embodiment, the guide roller 96 is formed as a spool with a central portion 98 flanked by a pair of radially enlarged portions 100 which maintain the follower or guide 96 within the cam channel or slot 92. Thus, the central portion 98 of the guide roller 96 forms a radial engaging surface that is maintained in contact with the sector gear portion or plate 30 by the sidewalls 88 defining the cam channel or slot 86. As will be appreciated and understood by those skilled in the art, the first channel portion 90 moves the guide 96 into a first position when received in the first channel portion 90 and moves the guide 96 into a second radially offset position when received in the second channel portion 92.

The sensor mechanism 94 further includes a rod 102 connected to the guide roller 96 and slidably connected to the sector gear portion 30 by holder 112. More specifically, the rod 102 has an end portion 104 to which the guide roller 96 is secured and an extending portion 106 which extends in a direction approximately parallel to the sector gear portion or plate 30 (e.g., either surface 30*a* or 30*b* of the sector gear portion or plate) and is oriented approximately perpendicular or normal relative to the end portion 104. In the illustrated embodiment, the end portion 104 of the rod 102 forms a first bent end of the rod 102 that carries the guide roller 96 and, as is described in more detail below, a second opposite end 108 of the rod is operatively engaged or connected with a stopper mechanism 110.

When the follower guide 96 is moved to its first position by the first channel portion 90, the guide 96 causes the rod 102 to move to a corresponding first position. Similarly, the guide 96 moves to its second position when in the second channel portion 92 and causes the rod 102 to move a corresponding second position. These first and second corresponding positions of the rod 102 are linearly spaced apart from one another along an axis defined by a longitudinal length of the rod 102, or at least a longitudinal length of the rod 102 adjacent to the end portion 104. As will be appreciated and understood by those skilled in the art, the guide 96 mechanically communicates with the stopper mechanism 110 through the rod 102 and the stopper mechanism 110 can be appropriately configured to prevent the slide door 14 from fully opening or moving to a fully open position when the rod 102 is in the second position (i.e., the rod mechanically communicating that the guide 96 is likewise in its second position as a result of being received in a second portion 92 of the cam channel or slot 86), while allowing the door 14 to fully open when the rod 102 is in the first position.

Figure 3:
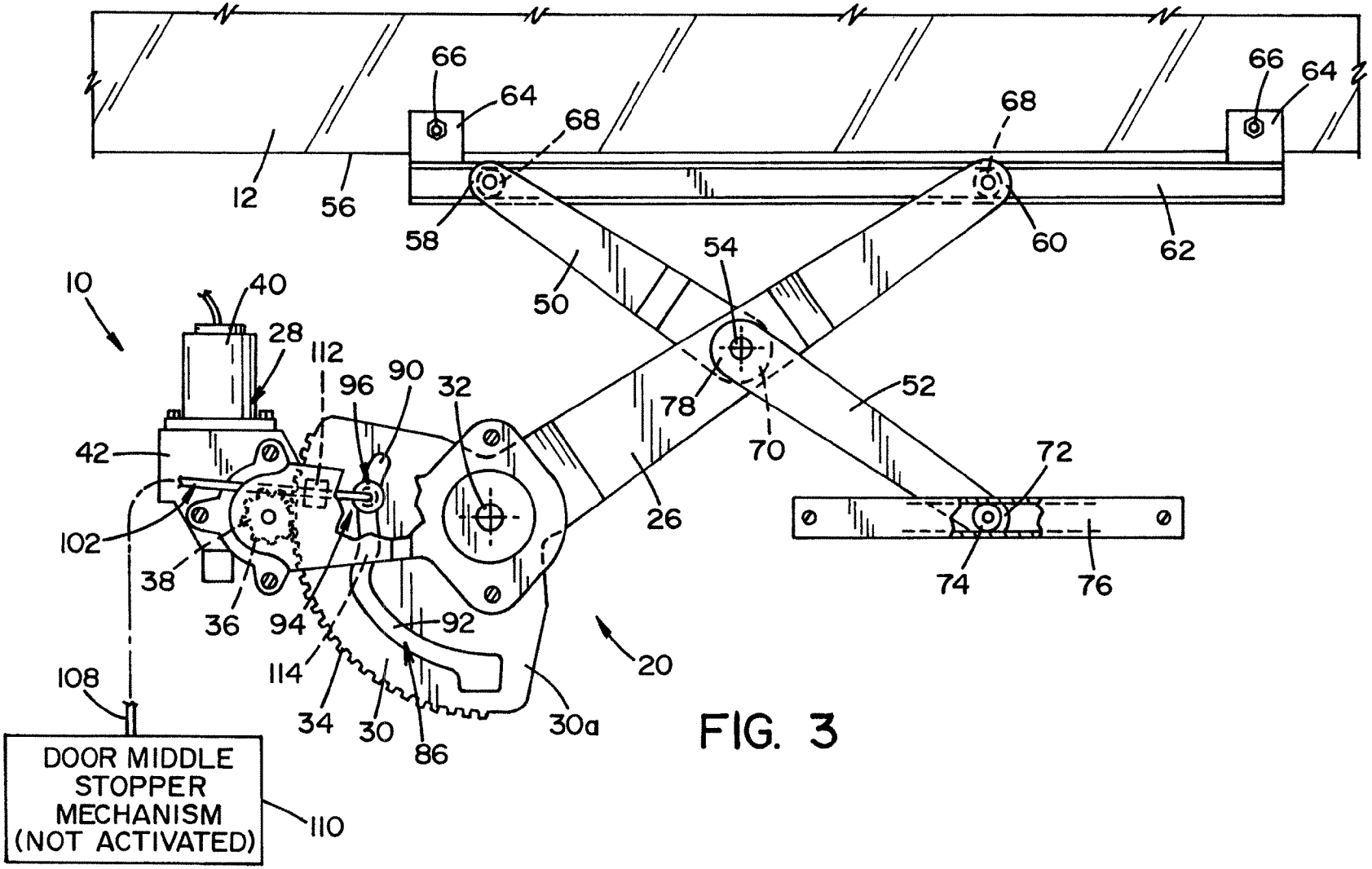
FIG. 3 is an elevational view of the window regulator mechanism removed from the slide door, shown holding a window pane in a closed position.
Figure 4:
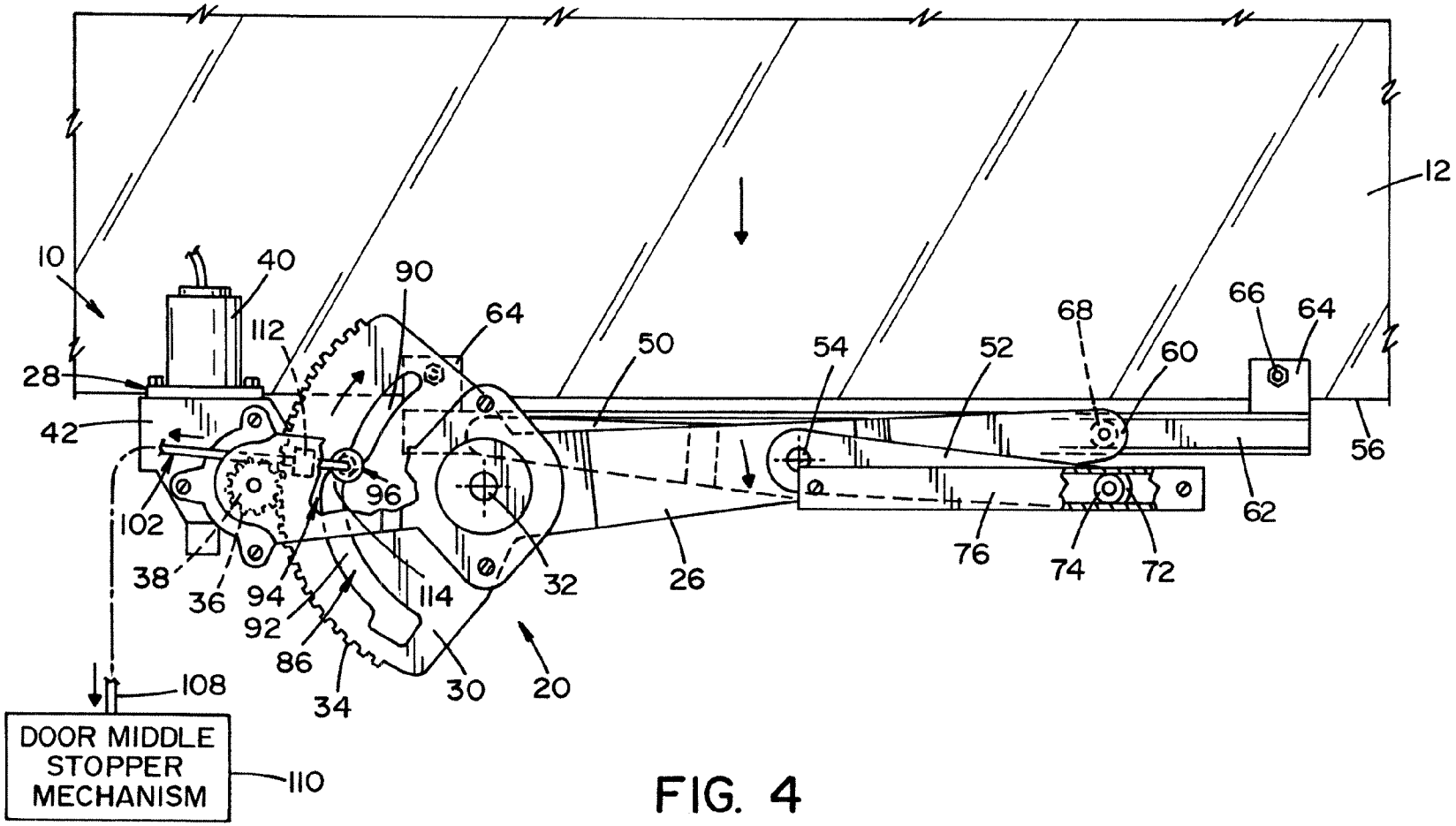
FIG. 4 is another elevational view of the window regulator mechanism removed from the vehicle slide door, shown holding the window pane in a partially open position.
Figure 5:
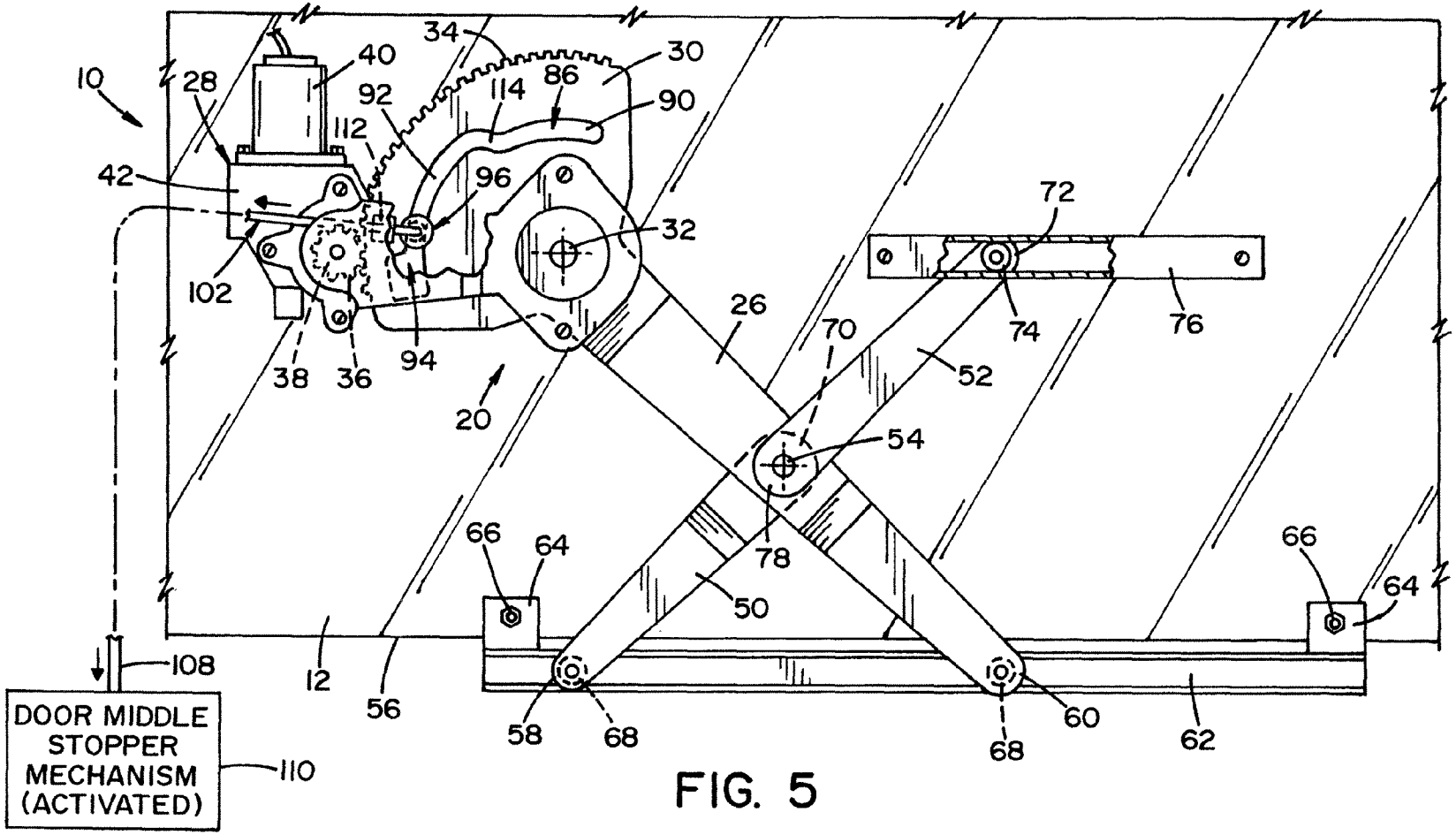
FIG. 5 is still another elevational view of the window regulator mechanism removed from the vehicle door, shown holding the window pane in a fully open position.
Figure 6:
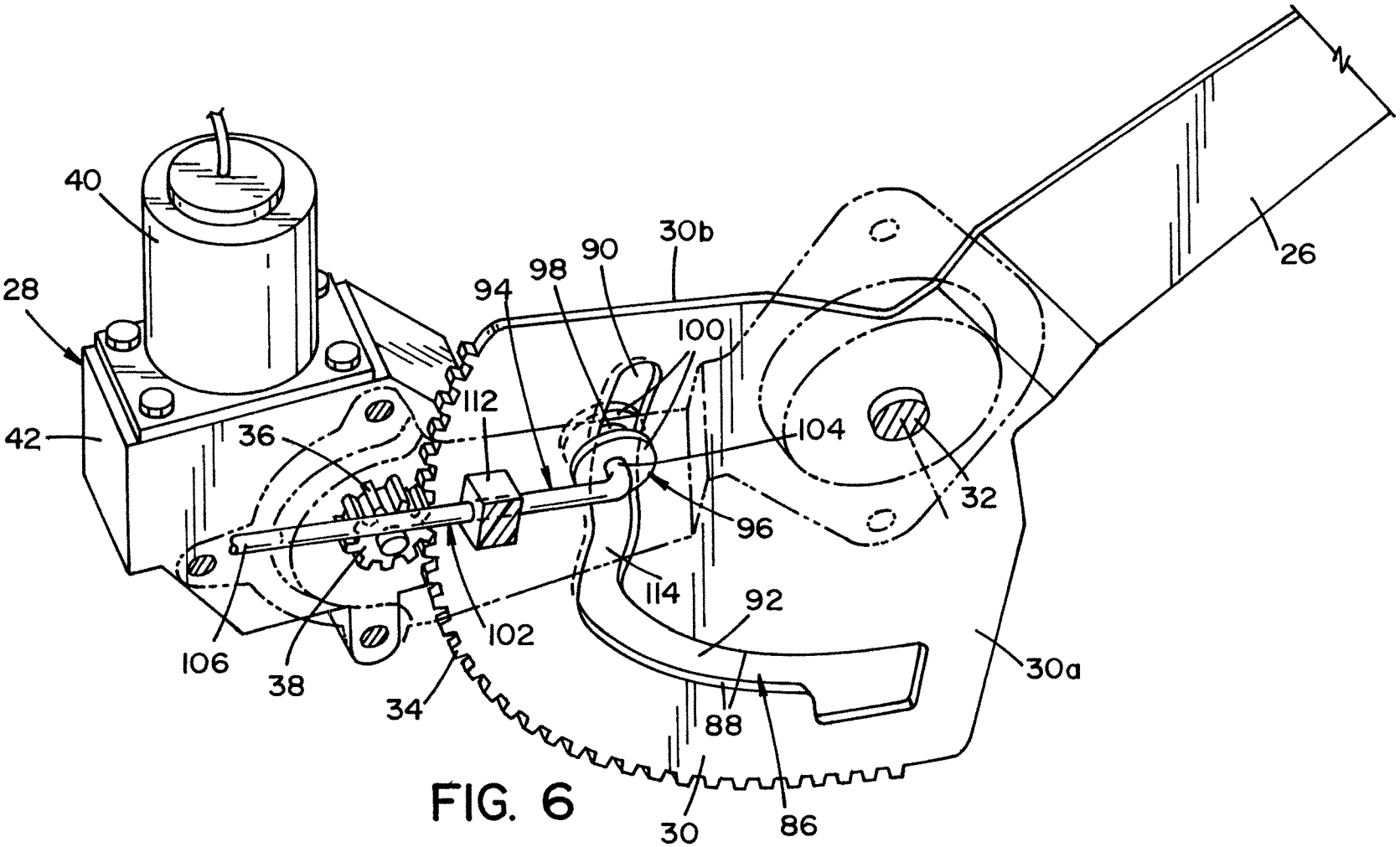
FIG. 6 is a partial perspective view of the window regulator mechanism.

With particular reference to FIGS. 3-5, operation of the door pane position sensor assembly 10 will now be described along with a method of sensing window pane position in the sliding vehicle door 14. To open the window pane 12 of the slide door 14, the sector gear portion or plate 30 of the main lift arm 26 is drivingly rotated by the drive mechanism 28. In particular, in the illustrated embodiment, the main lift arm 26 is rotated by the drive mechanism 28 in a clockwise direction about fixed pivot 32 to effect a downward movement of the window pane 12. Thus, rotation of the main lift arm 26 in the first rotatable direction causes the window pane 12 to move from the closed position illustrated in FIG. 3 to or toward the intermediate position illustrated in FIG. 4 and/or to or toward the open position illustrated in FIG. 5.

As best shown in FIG. 3, the follower 96 resides within the first channel portion 90 of the cam channel or slot 86 when the window pane 12 is in its closed or fully up position. The follower or guide 96 moves along the cam channel or slot 86 defined in the sector gear portion or plate 30 as the sector gear portion or plate and the main lift arm 26 are rotated. In FIG. 4, the window pane 12 has been moved to an intermediate position (i.e., a partially open position), but the guide 96 still resides within the first portion 90 of a cam channel or slot 86. Any further rotation of the main lift arm 26 in a first rotatable direction further opening the window pane 12 will cause the guide 96 to move into the second channel portion 92 of the cam channel or slot 86.

More specifically, the guide or follower 96 is moved into the second channel portion 92 when the sector gear portion 30 is driven in the first rotatable direction beyond the position illustrated in FIG. 4, which further moves the window pane 12 toward its fully open position. Moving of the follower guide 96 along the cam channel or slot 86 includes maintaining contact between the follower guide 96 and a sector gear portion or plate 30 by having the follower of guide 96 positioned between the opposed sidewalls 88 of the sector gear portion or plate 30 that define the cam channel or slot 86. As shown in FIGS. 3 and 4, the guide 96 maintains the rod 102 in a first position until the window 12 is opened sufficiently beyond a transition portion 114 of the cam channel or slot 86 disposed between the first and second channel portions 90, 92.

Figure 2:
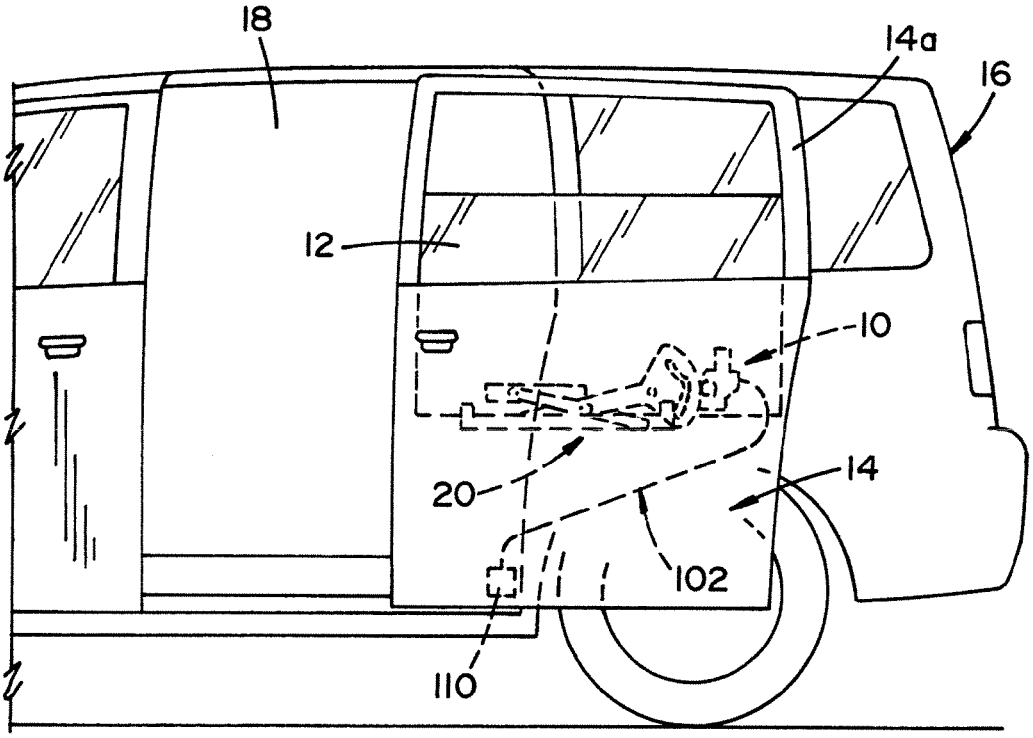
FIG. 2 is a schematic elevational view of the slide door of FIG. 1 with the window held in a partially open position by the window regulator mechanism.

Upon passing this transition portion 114, the rod 102 is moved to its second position by the second channel portion 92 which is radially displaced toward the sector gear teeth 34 relative to the first channel portion 90. In the second position, the rod 102 mechanically communicates to the stopper mechanism 110 that the window has been opened beyond a predetermined position. The predetermined position can vary from the illustrated embodiment, but is generally selected to correspond to a position beyond which it is not deemed safe to allow the sliding door 14 to open. Accordingly, the stopper mechanism 110 will prevent fully opening of the door 14 when the rod 102 is in its second position, as illustrated in FIG. 2.

The result of further rotation of the main lift arm 26 is illustrated in FIG. 5, wherein the main lift arm 26 and the sector gear portion or plate 30 are shown fully rotated such that the window pane 12 is in its fully open position. In this position, the guide 96 remains in the second portion 92 and the rod 102 mechanically communicates to the stopper mechanism 110 that it should continue to prevent opening of the door 14. When the main lift arm 26 is rotated in the second direction (i.e., counterclockwise in FIGS. 3-5) from the window position of FIG. 4 or FIG. 5, the window pane 12 moves toward its closed position. Upon passing the position of FIG. 4, the guide 96 moves back into the first portion 90 and the rod 102 mechanically communicates to the stopper mechanism that it is again acceptable to allow fully opening of the door 14.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A door pane position sensor assembly, comprising:

a main lift arm supporting a pane in a vehicle door, said main lift arm including a sector gear portion for being driven to rotate said main lift arm;

a drive mechanism operatively engaged with said sector gear portion for rotating said main lift arm in a first rotatable direction to move said pane toward a closed position and a second rotatable direction to move said pane toward an open position;

a non-uniform cam channel defined in said sector gear portion including a first channel portion and a second channel portion;

a sensor mechanism having a follower received in said cam channel, said follower moving along said cam channel as said main lift arm rotates to move said pane toward said open and closed positions, said follower moving said sensor mechanism toward a first position when said follower is moved into said first channel portion of said cam channel and toward a second position when said follower is moved into said second channel portion of said cam channel.

2. The door pane position sensor assembly of claim 1, wherein said first channel portion corresponds to said pane being between an intermediate position and said closed position and said second channel portion corresponds to said pane being between said intermediate position and said open position, said sensor mechanism is in said first position when said pane is between said intermediate position and said closed position and in said second position when said pane is between said intermediate position and said open position.

3. The door pane position sensor assembly of claim 1 wherein said sector gear portion is a single plate having sector gear teeth meshingly engaged with driving teeth of said drive mechanism, said cam channel defined through said single plate.

4. The door pane position sensor assembly of claim 3 wherein said follower is a guide roller received through single plate in said cam channel, said guide roller guided by opposing sides of said cam channel which maintain said guide roller in contact with said sector gear portion.

5. The door pane position sensor assembly of claim 4 wherein said sensor mechanism includes a rod having an end portion to which said guide roller is secured and an extending portion which extends in a direction approximately parallel to said single plate and is oriented approximately perpendicular relative to said end portion.

6. The door pane position sensor assembly of claim 3 wherein said driving teeth of said drive mechanism are disposed on a pinion gear, which is driven by a motor of said drive mechanism.

7. The door pane position sensor assembly of claim 1 wherein said sensor mechanism is a rod and said follower is a guide roller secured to said rod.

8. The door pane position sensor assembly of claim 7 wherein said rod includes a first bent end carrying said guide roller and a second, opposite end operatively engaged with a stopper mechanism, said stopper mechanism preventing full opening of the vehicle door when said rod is in said second position.

9. The door pane position sensor assembly of claim 8 wherein said vehicle door is a slide door and said stopper position prevents said slide door from fully opening when said rod is in said second position.

10. The door pane position sensor assembly of claim 1 wherein sector gear portion, which includes said cam channel defined therein, is disposed at one end of said main lift arm.

11. The door pane position sensor assembly of claim 10 wherein a second end of said main lift arm is pivotally connected to said pane, said main lift arm pivotally connected to the vehicle door at a fixed pivot location disposed between said ends of said main lift arm such that said sector gear portion is entirely disposed on one side of said fixed pivot location along said main lift arm.

12. The door pane position sensor assembly of claim 11 wherein said second end of said main lift arm is pivotally connected to a main guide rail that carries a lower end of said pane, a first sub lift arm having one end pivotally connected to said main lift arm at a sub arm pivot location between said fixed pivot location and said second end and having a second end pivotally connected to said main guide rail at a location spaced apart from where said main lift arm pivotally connects to said main guide rail, a second sub lift arm having one end pivotally connected to said main lift arm at said sub arm pivot location and having a second end pivotally connected to the vehicle door at a vertically fixed location.

13. A sensor assembly for detecting the position of an openable pane in a slide door of a vehicle, comprising:

a window regulator mechanism including a main lift arm supporting the pane and a drive mechanism for moving the pane in downward and upward directions when said drive mechanism rotates said main lift arm in opposite directions to effect opening and closing of a window portion of the slide door, said main lift arm including a sector gear plate at one end thereof for being drivingly rotated by said drive mechanism with said sector gear plate having a non-uniform slot defined therein; and a sensor mechanism having a guide received in said slot for moving along said slot as said main lift arm is rotated, said slot having a first portion that moves said guide into a first position when said guide is received in said first position and having a second portion that moves said guide into a second position when said guide is received in said second portion.

14. The sensor assembly of claim 13 wherein said slot is defined by side walls extending through said sector gear plate from a first surface of said sector gear plate to a second, opposite surface of said sector gear plate.

15. The sensor assembly of claim 14 wherein said guide is a guide roller having a radial engaging surface maintained in contact with said sector gear plate by said side walls defining said slot.

16. The sensor assembly of claim 15 wherein said sensor mechanism further includes a rod connected to said guide, said guide moving to said first position causes said rod to move to a corresponding first position, and said guide moving to said second position causes said rod to move to a corresponding second position, said first and second corresponding positions linearly spaced apart from one another along an axis defined by a longitudinal length of said rod.

17. The sensor assembly of claim 13 wherein said window regulator mechanism is an x-link window regulator including first and second sub arms pivotally connected to said main lift arm, said first sub arm and said main lift arm respectively having one end pivotally connected to a lower end of the openable pane, said second sub arm having one end pivotally connected at a fixed location to the slide door, said main lift arm pivotally connected at a vertically fixed location, which is disposed between a location where said sub arms pivotally connect to said main lift arm and said sector gear plate, to the slide door.

18. A sensor assembly for detecting the position of an openable pane in a slide door of a vehicle, comprising:

a window regulator mechanism including a main lift arm supporting the pane and a drive mechanism for moving the pane in downward and upward directions when said drive mechanism rotates said main lift arm in opposite directions to effect opening and closing of a window portion of the slide door, said main lift arm including a sector gear plate at one end thereof for being drivingly rotated by said drive mechanism with said sector gear plate having a slot defined therein; and a sensor mechanism having a guide received in said slot for moving along said slot as said main lift arm is rotated, said slot having a first portion that moves said guide into a first position when said guide is received in said first position and having a second portion that moves said guide into a second position when said guide is received in said second portion, wherein said guide mechanically communicates with a stopper mechanism through a rod, said stopper mechanism preventing the slide door from moving to a fully open position when said rod mechanically communicates that said guide is in said second position as a result of being received in said second portion of said slot.

* * * * *